US006553573B1

(12) United States Patent
Brown

(10) Patent No.: US 6,553,573 B1
(45) Date of Patent: Apr. 29, 2003

(54) VOLLEYBALL PROTECTOR PAD

(75) Inventor: Michael D. Brown, Bethlehem, GA (US)

(73) Assignee: Innovation and Design, Inc., Bethleham, GA (US)

( * ) Notice: Subject to any disclaimer, the term of this patent is extended or adjusted under 35 U.S.C. 154(b) by 0 days.

(21) Appl. No.: 09/993,199

(22) Filed: Nov. 13, 2001

(51) Int. Cl.[7] ..... A41D 13/00
(52) U.S. Cl. ..... 2/24
(58) Field of Search ..... 2/456, 455, 463, 2/16, 24, 267, 911; 602/23, 26, 62

(56) References Cited

U.S. PATENT DOCUMENTS

| | | | | |
|---|---|---|---|---|
| 4,462,115 A | | 7/1984 | Carlson et al. | |
| 4,484,361 A | * | 11/1984 | Leighton et al. | 2/16 |
| 4,494,247 A | * | 1/1985 | Kelly | 2/16 |
| 4,796,303 A | | 1/1989 | Atwater | |
| 5,309,570 A | * | 5/1994 | Grimm | 2/24 |
| 5,537,689 A | | 7/1996 | Dancyger | |
| 6,098,209 A | | 8/2000 | Bainbridge et al. | |
| 6,223,350 B1 | | 5/2001 | McFarlane | |
| 6,253,376 B1 | | 7/2001 | Ritter | |

OTHER PUBLICATIONS

Commercial knee pad advertisement www.tools4floors.com/knee–padsx.html (4 pages).

* cited by examiner

*Primary Examiner*—Gloria M. Hale
*Assistant Examiner*—Tejash Patel
(74) *Attorney, Agent, or Firm*—Judy Jarecki-Black

(57) ABSTRACT

The present invention provides a protector pad particularly adapted for use by volleyball players and the like comprising an outer section, a substantially flat inner section comprising a synthetic polymer, and a unitary attachment strap which, in one embodiment of the present invention, is integrally incorporated with the outer section. The attachment strap extends over the lower ⅔ of the pad such that the strap is positioned below the knee or elbow joint of the wearer, thus permitting the wearer's knee or elbow to be unrestrictedly flexed when the pad is attached. A pad according to the present invention protects the wearer's knee or elbow joint from contact with a hard surface, while simultaneously reducing friction between the pad and a contacting surface, permitting the wearer's elbow or knee to easily slide when the padded joint contacts the ground or other hard surface.

7 Claims, 5 Drawing Sheets

VOLLEYBALL PROTECTOR PAD

FIELD OF THE INVENTION

The present invention relates in general to a protector pad particularly suited for use by volleyball players and the like. In particular, the present invention comprises a protector pad having a cushioned inner section that fits over a wearer's knee or elbow joint and further includes an attachment strap for attaching the pad below the joint such that the flexibility of the wearer's knee or elbow joint is not compromised.

BACKGROUND OF THE INVENTION

Conventional knee pads that protect the knees while the wearer is working or playing sports are known in the prior art. For example, U.S. Pat. No. 4,796,303 to Atwater discloses a protective pad comprising an elastic sleeve having sufficient length to cover the knee and adjacent portions of the calf and thigh of the wearer.

U.S. Pat. No. 5,537,689 to Dancyger teaches a knee pad useful for construction workers and the like having a substantially egg-shaped cup that conforms to the knee and, in the preferred embodiment, is designed to provide easy swiveling around the knee without slippage. The knee pad taught by Dancyger further includes two strapping means for attaching the knee pad to the knee of the user.

Other protective padding useful for protecting the wearer from damage during contact with the ground or other surface includes pads disclosed in U.S. Pat. No. 6,098,209 to Bainbridge et al., U.S. Pat. No. 6,223,350 to McFarlane, and U.S. Pat. No. 6,253,376 to Ritter. The protective padding taught by Bainbridge et al. comprises flexible, outer casings of porous, breathable, inelastic material overfilled with resilient beads of elastic material. U.S. Pat. No. 6,223,350 to McFarlane, directed to a molded, elastomeric knee pad having a multi-segmented, integrally molded shape, further includes a retention strap positioned on the lower ⅔ of the pad for holding the pad over the knee. Ritter teaches a knee pad with a cushion section having a fluid-filled chamber filled with a gas, a liquid, a gel or another fluid.

None of the above inventions and patents, taken either singly or in combination, is seen to describe the instant invention as claimed.

SUMMARY OF THE INVENTION

The present invention is directed to a protector pad comprising an elastomeric material primarily for use by volleyball players and the like for cushioning a human knee or elbow joint from contact with the ground or other surface.

The protector pad of the present invention is designed to permit easy flexibility and moveability of the joint over which it is attached and, in one embodiment, comprises a concave back side conforming to the shape of the knee or elbow joint and a front side having a convex shape but including a generally flat cushion pad. The protector pad further includes an outer section, comprising an elastomeric foam or the like permitting the pad to fit snugly around the wearer's knee or elbow joint, and an inner section comprising a substantially flat synthetic polymer or the like, such that the pad protects the wearer's joint from contact with the ground or other hard surface while simultaneously reducing friction between the pad and a contacting surface, permitting the wearer's elbow or knee to easily slide when the padded joint contacts the ground or other hard surface. The protector pad of the present invention further includes a unitary attachment strap extending over the lower ⅔ of the pad such that the attachment strap is positioned below the knee or elbow joint when the pad is attached to the wearer, permitting the wearer's knee or elbow to be unrestrictedly flexed when the pad is attached to, and covers, the wearer's joint. In one embodiment of a protector pad made according to the present invention, the unitary attachment strap is integrally incorporated with the outer section of the pad such that the outer section of the pad and the attachment strap are made as one unit.

Thus, it is an object of the present invention to provide an improved, flexible protector pad to attach to, and cover, a wearer's knee or elbow joint. The protector pad of the present invention comprises an outer section, comprising an elastomeric foam or the like and further comprising a unitary attachment strap, and an inner section comprising a substantially flat synthetic polymer or the like, and further comprising a cushion section having sufficient thickness to protect the wearer's knee or elbow from contact with the ground or other hard surface while simultaneously reducing friction between the pad and the ground surface, such that the wearer's joint covered by the pad slides freely across the surface with which it comes into contact.

These and other objects, features and advantages of the present invention will become more apparent upon review of the detailed description set forth below when taken in conjunction with the accompanying figures, which are briefly described as follows.

DETAILED DESCRIPTION OF THE PREFERRED EMBODIMENTS

Other objects, features and aspects of the present invention are disclosed in, or are obvious from, the following Detailed Description, one or more examples of which are illustrated in the accompanying drawings. It is to be understood by one of ordinary skill in the art that the present discussion is a description of exemplary embodiments only and is not intended as limiting the broader aspects of the present invention, which broader aspects are embodied in the exemplary constructions. In fact, it will be apparent to those skilled in the art that various modifications and variations can be made in the present invention without departing from the scope or spirit of the invention. For instance, features illustrated or described as part of one embodiment can be used in another embodiment to yield a still further embodiment. It is intended that the present invention cover such modifications and variations as come within the scope of the appended claims and their equivalents.

Referring now to the Figures, the protector pad of the present invention is illustrated. Protector pad 10 comprises a concave back side, conforming to the shape of the knee or elbow to which it attaches, and a front side having a convex shape and having sufficient thickness to protect the joint which it covers, and to which it is attached, from contact with the ground or other hard surface.

Figure 1:
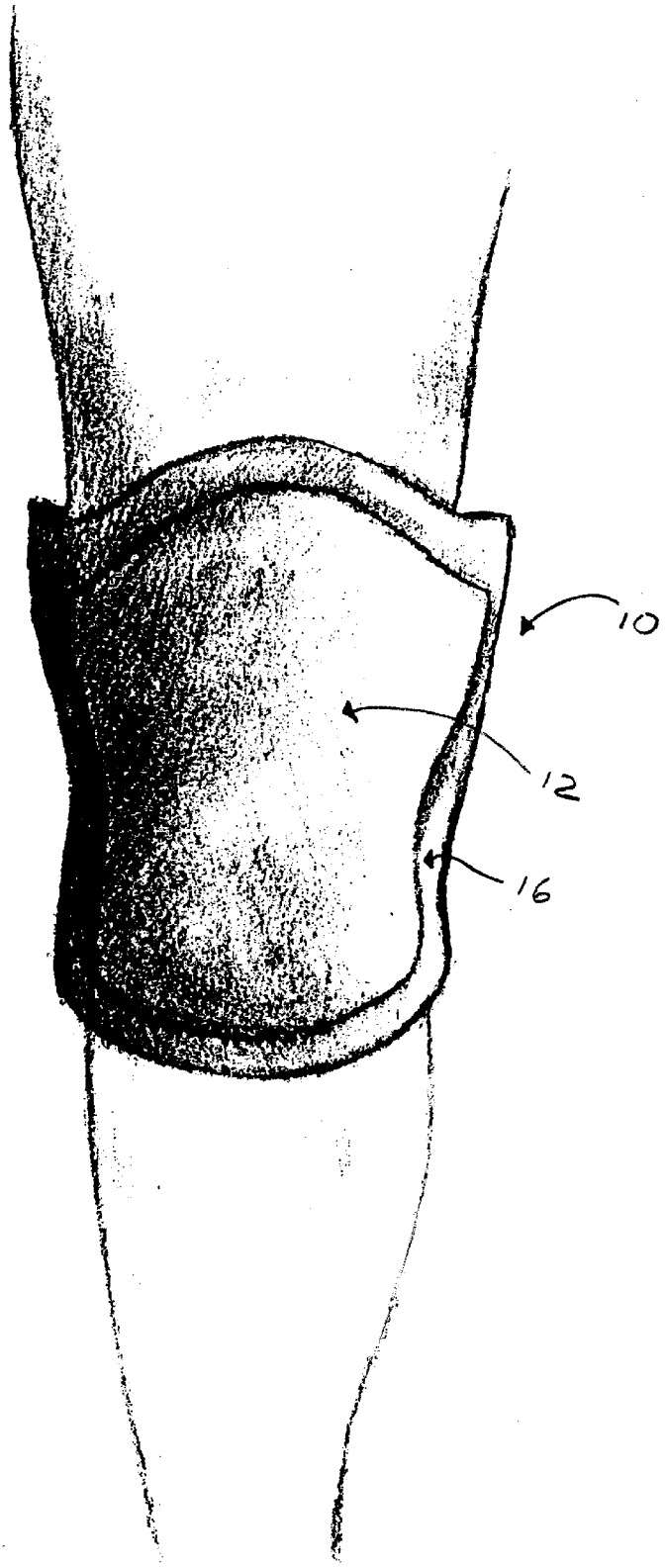
FIG. 1 is a schematic illustration of a protector pad made according to the present invention.

As illustrated in FIG. 1, protector pad 10 comprises inner section 12, outer section 16, and attachment strap 18. In one embodiment of the present invention, inner section 12 comprises any generally flat synthetic polymer including, but not limited to neoprene, including unbroken loop (UBL) neoprene; foam; synthetic rubber; natural rubber; polybutadiene rubber; styrene; natural latex; synthetic latex; polyurethane; polyethylene; sorbothane; silicon; and the like, or any combination thereof, that permits the wearer's knee or elbow to be protected from contact with the ground or other hard surface while simultaneously reducing friction between inner section 12 of pad 10 and the surface, such that the wearer's joint covered by the pad slides freely across the surface with which it comes into contact. Inner section 12 is attached in a substantially permanent manner to outer section 16.

Inner section 12 is attached to outer section 16 by any conventional means of attachment including, but not limited to, stitching means: gluing means; adhesive means; fabric means; taping means such as VELCRO tape; and the like, or any combination thereof such that inner section 12 is substantially permanently attached to outer section 16.

Outer section 16 comprises a substantially flat elastomeric material including, but not limited to, foam; rubber; knit fabric; and the like, or any combination thereof, permitting outer section 16 to have sufficient stretch characteristics that it will fit all sizes of wearers. However, as will be appreciated by one of ordinary skill in the art, outer section 16 can be made from any conventional material having sufficient stretchability to permit pad 10 to easily slide into position over the wearer's knee or elbow joint, while in a stretched position, yet permit pad 10 to return to a relaxed position sufficient to permit pad 10 to be secured snugly once positioned over the wearer's joint and returned to a relaxed position.

Figure 2:
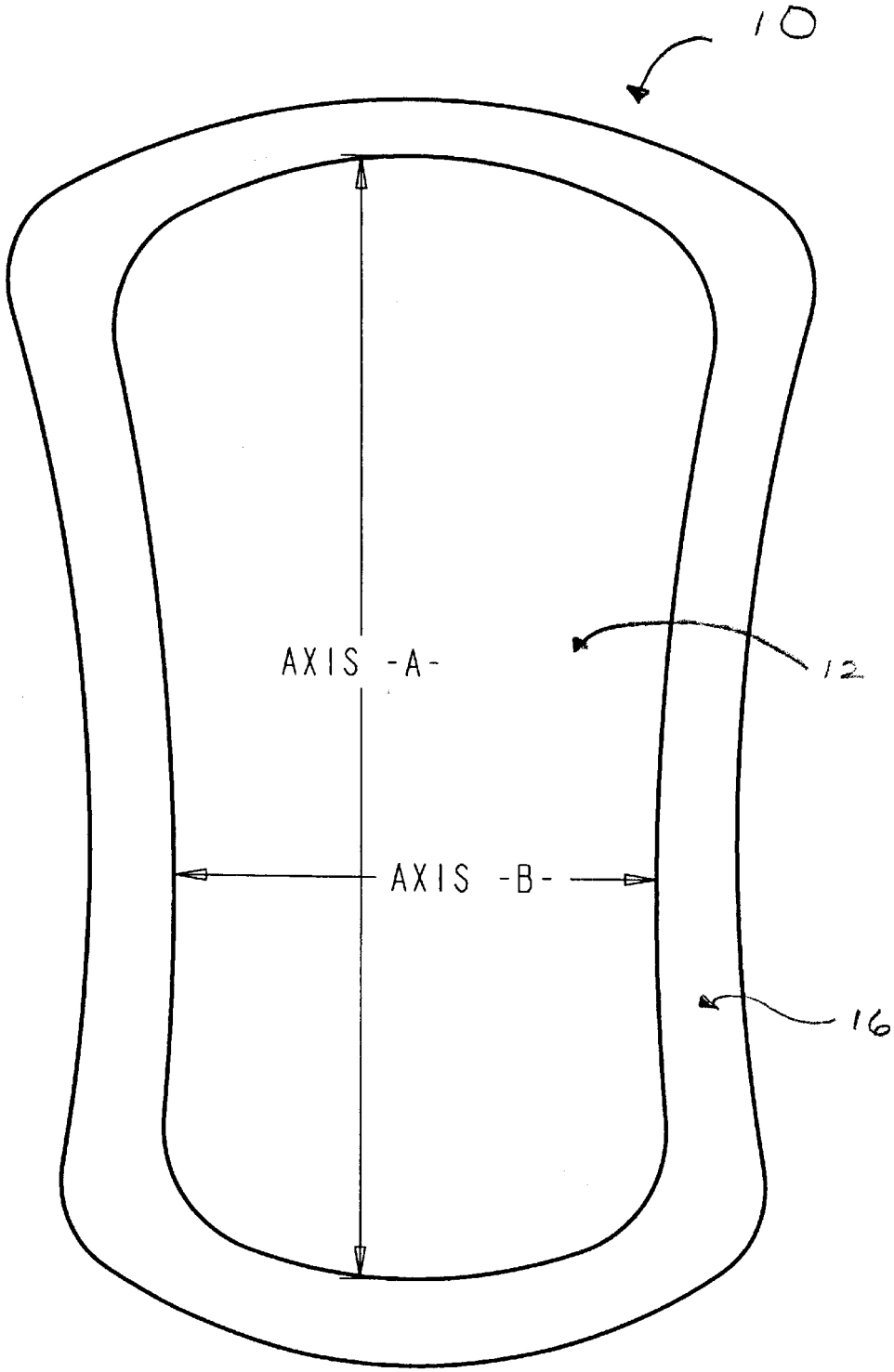
FIG. 2 is a schematic view of the inner section made according to one embodiment of the present invention and illustrating an hour-glass configuration thereof.

Referring now to FIG. 2, a protector pad having one configuration contemplated within the scope of the present invention is illustrated. As seen in FIG. 2, inner section 12 has a substantially hour-glass configuration with a major axis, indicated at A, extending longitudinally across the joint of the wearer and being of sufficient length to cover substantially the entire joint to which the pad is attached, and a minor axis, indicated at B, extending transversely across the joint of the wearer and being of sufficient width to cover opposite sides of the joint while being substantially shorter than the major axis. In one embodiment of the present invention, inner section 12 is formed of ½ inch polyurethane foam having a major axis measuring about 9 inches and a minor axis which is approximately 4 inches while outer section 16 is formed of 3/16 inch polyurethane foam, having a major axis measuring about 10 inches and a minor axis which is about 5 inches. Thus, in one embodiment contemplated by the present invention, the circumference of outer surface 16 is approximately 6 inches larger than that of cushion section 12.

Figure 3:
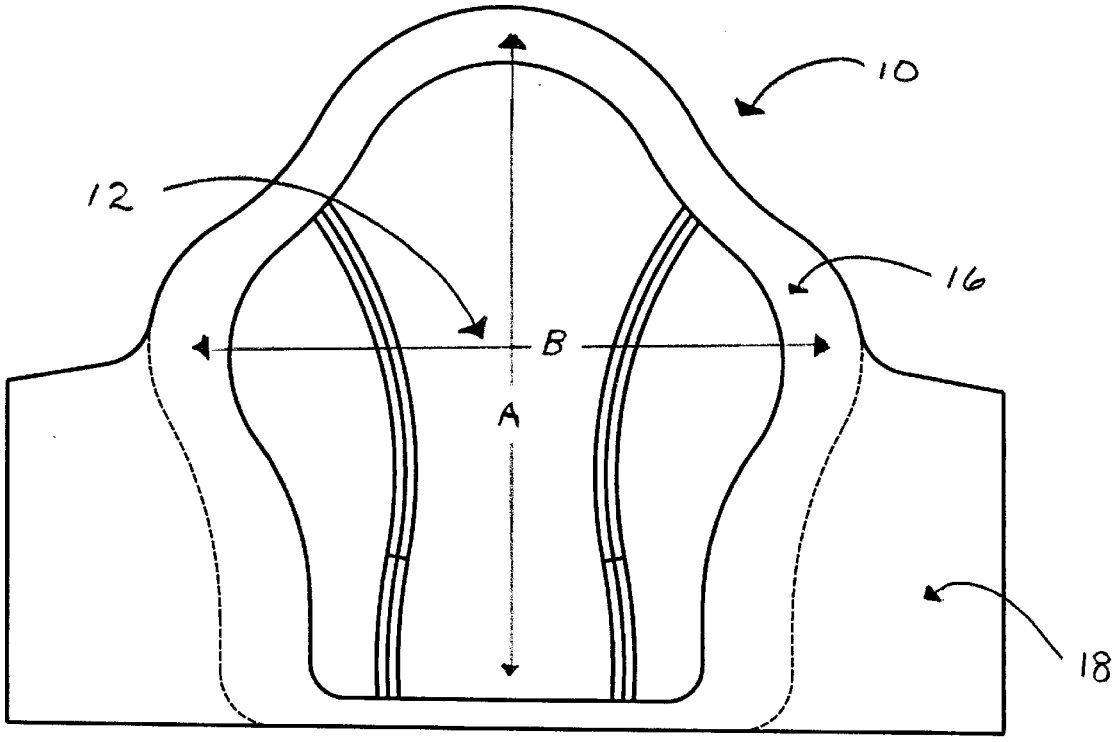
FIG. 3 schematically illustrates an alternate embodiment of a protector pad made according to the present invention and having a clover-leaf configuration thereof.

Referring now to FIG. 3, an alternate configuration for a protector pad made according to the present invention is illustrated. As shown by FIG. 3, inner section 12 has a substantially clover-leaf configuration with a vertical axis, indicated at A, extending longitudinally across the joint of the wearer and being of sufficient length to cover substantially the entire joint to which the pad is attached, and a horizontal axis, indicated at B, extending transversely across the joint of the wearer and being of sufficient width to cover opposite sides of the joint while being substantially equal in length to the vertical axis.

In one embodiment of the present invention having a clover-leaf configuration, inner section 12 is formed of ½ inch polyurethane foam having a vertical axis measuring about 10 inches and substantially equal to the measurement of a horizontal axis.

Outer section 16 is attached to unitary attachment strap 18, as illustrated in FIGS. 4A and 4B. Attachment strap 18 comprises a substantially flat elastomeric material including, but not limited to, foam; knit; synthetic rubber; natural rubber; polyurethane; polypropylene; polyethylene and the like, or any combination thereof. However, as one of skill in the art will recognize, any conventional material that permits attachment strap 18 of pad 10 to be secured to and over the wearer's joint, such that the pad does not easily slip out of its attached position over the joint, yet permits strap 18 to be stretched temporarily to allow the wearer to easily put-on and remove the pad, can be used to make attachment strap 18 according to the present invention.

Attachment strap 18, extending over the lower ⅔ of pad 10 such that attachment strap 18 is positioned below the knee or elbow joint when the pad is attached to the wearer, permits the wearer's knee or elbow joint to be unrestrictedly flexed when the pad is attached to, and covers, the joint. Attachment strap 18 is attached to outer section 16 by conventional attachment means including, but not limited to, hooks; snaps; staples; stitching means; gluing means; adhesive means; cementing means; fabric means such as Velcro, and the like or any combination thereof such that attachment strap 18 is substantially permanently attached to outer section 16.

In an alternate embodiment of the present invention, outer section 16 is integrally incorporated with attachment strap 18, such that outer section 16 is made as one unit with attachment strap 18, forming a sleeve that can be stretchably positioned over the wearer's joint.

Figure 4:
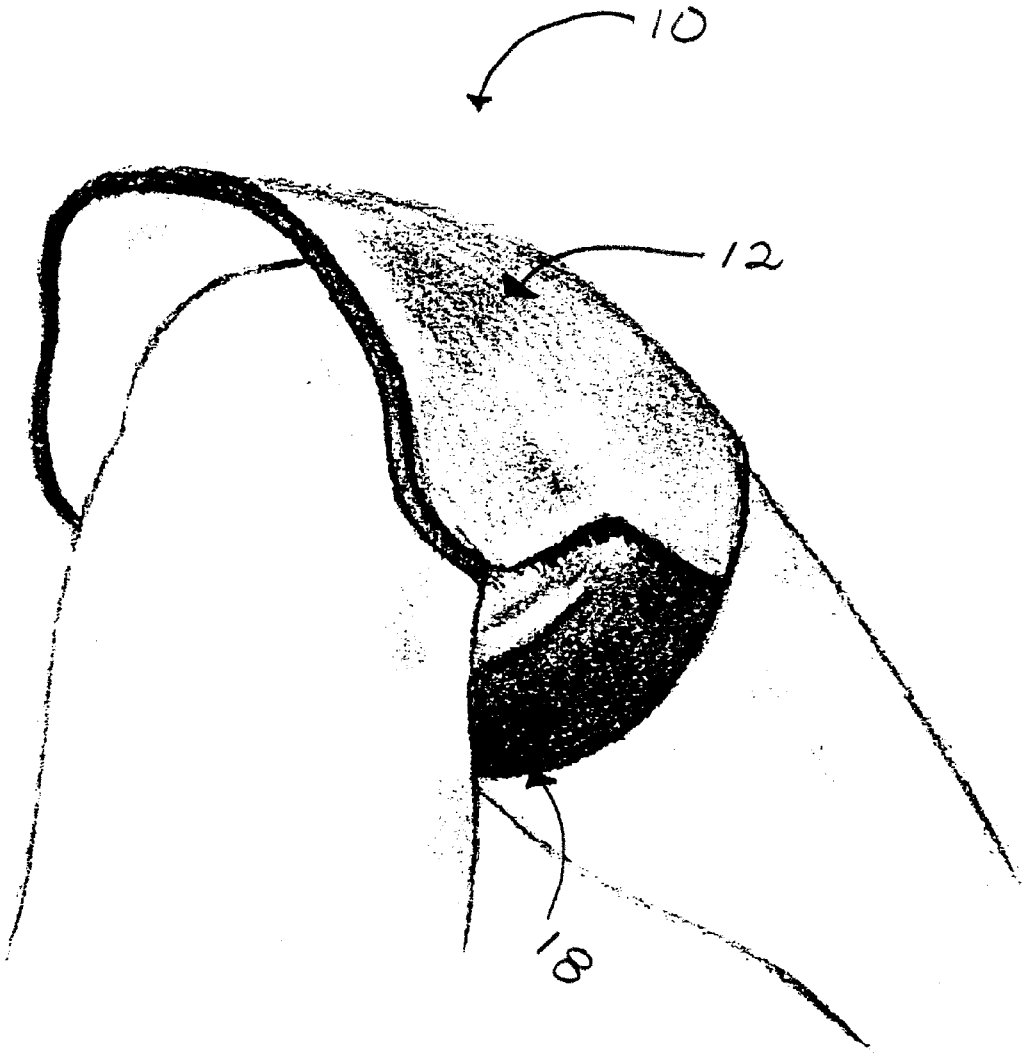
FIG. 4 illustrates a protector pad made according to the present invention and positioned onto and over the joint of a wearer.
Figure 5:
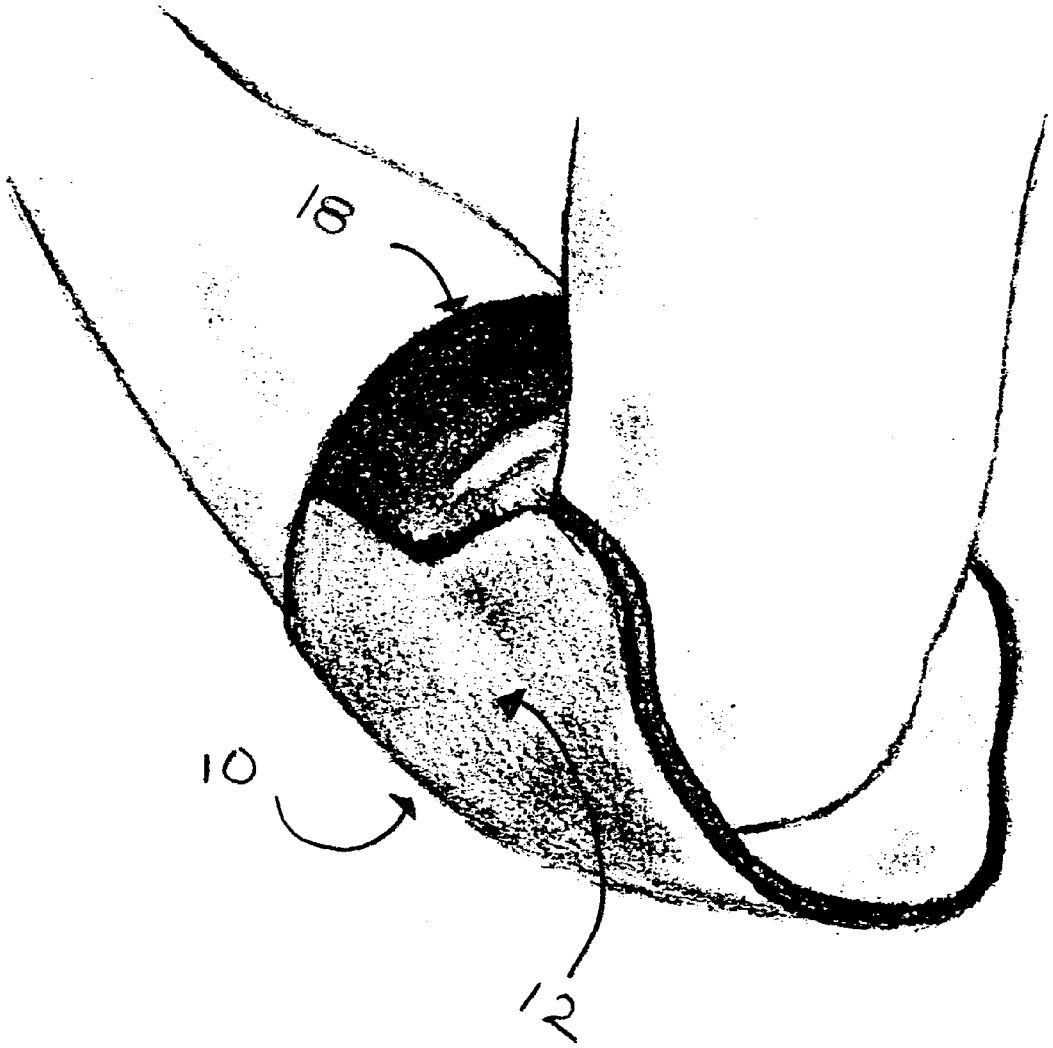
FIG. 5 illustrates the pad positioned to and covering a wearer's knee as the knee is flexed to make contact with a hard surface.

Referring now to FIG. 4, protector pad 10 is illustrated attached to, and covering, the knee joint of a wearer by means of attachment strap 18 which is integrally incorporated with outer section 16 and extends over the lower ⅔ of pad 10 such that attachment strap 18 is positioned below the knee or elbow joint when the pad is attached to the wearer, thus permitting the wearer's knee or elbow to be unrestrictedly flexed when pad 10 is attached. As illustrated in FIG. 5, when the wearer's knee is in position to contact a hard surface, the protector pad allows the joint to be unrestrictedly flexed while simultaneously providing the knee with protection against contact with the surface.

While the present invention has been described with reference to specific features and embodiments, such description is for illustrative purposes only. The words used are words of description rather than of limitation. Thus, the thickness of the protector pad may be varied in order to optimize the cushioning effect provided. Similarly, the dimension and extent of each of the measurements of each of the sections forming the protector pad may be varied to provide for various types of bending of the pad. It is to be understood that changes and variations may be made by those of ordinary skill in the art without departing from the spirit or scope of the present invention, which is set forth in the following claims.

What is claimed is:

1. A protector pad for cushioning and protecting the knee or elbow joint of a volleyball player and the like, said protector pad comprising:

an outer section of elastomeric fabric having sufficient length to cover the joint and adjacent portions of the arm or leg of the wearer and having sufficient elasticity to snugly fit the area of the joint of the wearer, a substantially flat inner section having a substantially clover-leaf configuration, and an unitary attachment strap integrally incorporated with the outer section and extending over the lower ⅔ of the protector pad such that the attachment strap is positioned below the knee or elbow joint when the pad is attached to the wearer, thus permitting the wearer's knee or elbow to be unrestrictedly flexed when the protector pad is attached to the wearer.

2. The protector pad of claim 1 wherein said clover-leaf configuration further comprises a vertical axis, extending longitudinally across the joint of the wearer, and a horizontal axis, extending transversely across the joint, and wherein the vertical axis is equal in length to the horizontal axis.

3. The protector pad of claim 1 wherein said inner pad comprises neoprene.

4. The protector pad of claim 3, wherein the neoprene is unbroken loop (UBL) neoprene.

5. The protector pad of claim 1, wherein the inner section further comprises decorative stitching.

6. The protector pad of claim 1, wherein the inner section is attached to the outer section by means of an adhesive.

7. The protector pad of claim 1, wherein the inner section is attached to the outer section by means of stitching.

* * * * *